US005761972A

United States Patent [19]

Sanders

[11] Patent Number: 5,761,972

[45] Date of Patent: Jun. 9, 1998

[54] RATCHET WRENCH WITH REMOTE ADVANCING LEVER

[76] Inventor: John A. Sanders, 200 S. Crest, Chattanooga, Tenn. 37404

[21] Appl. No.: 744,727

[22] Filed: Oct. 29, 1996

[51] Int. Cl.[6] ..... B25B 13/46

[52] U.S. Cl. ..... 81/60; 81/63.2

[58] Field of Search ..... 81/57, 39, 60–63

[56] References Cited

U.S. PATENT DOCUMENTS

| | | | |
|---|---|---|---|
| 1,188,801 | 6/1916 | McEwen . | |
| 2,954,715 | 10/1960 | Wycech | 81/57.39 X |
| 3,283,621 | 11/1966 | Faso | 81/54 |
| 3,952,617 | 4/1976 | Gegg | 81/62 |
| 4,258,594 | 3/1981 | Welch | 81/57 |
| 4,277,989 | 7/1981 | Tracy | 81/62 |
| 4,406,183 | 9/1983 | Wix | 81/57 |
| 4,406,184 | 9/1983 | Cockman, Jr. | 81/57 |
| 4,425,828 | 1/1984 | Berdinner | 81/57.39 |
| 4,545,267 | 10/1985 | Shumway | 81/57 |
| 4,699,028 | 10/1987 | Bosque | 81/57 |
| 5,309,796 | 5/1994 | Jones | 81/57.39 |

*Primary Examiner*—James G. Smith
*Attorney, Agent, or Firm*—Waddey & Patterson; I. C. Waddey, Jr.

[57] ABSTRACT

A ratchet wrench having a handle and a head of know configuration with the head including a raceway in which is mounted a spur gear. The spur gear has a shaft passing through it which cooperates with the head of the wrench to hold the gear in place with one end of the shaft including a post for attachment of a socket. Within the head of the wrench is a pawl mechanism for engaging the teeth of the spur gear so that when the handle is rotated in one direction, the pawl mechanism will engage the spur gear and turn the spur gear, its shaft and the post to which a socket is attached. When the handle is rotated in the opposite direction, the pawl mechanism will ride over the spur gear so that the spur gear will remain stationary. The improvement of applicant's invention is an advancing lever built into the handle of the wrench. The advancing lever includes an advancing rod with camming teeth on the free end of the advancing rod and pivotally connected to a link rod at the opposite end. The advancing rod can be shifted from one side or the other of the head so as to engage one side or the other of the spur gear and thereby advance the spur gear in one direction or the other depending upon the side on which the advancing rod is placed. The advancing rod is activated by the link rod pushing toward the spur gear in response to force applied to the advancing lever on the handle of the wrench. The advancing lever is fitted within a slot in the handle and connects to the link rod so that the advancing lever can be pushed toward the head of the wrench to push the advancing rod forward. The advancing lever is then returned to its original position by the force of a coil spring wrapped about the link rod.

7 Claims, 4 Drawing Sheets

RATCHET WRENCH WITH REMOTE ADVANCING LEVER

BACKGROUND OF THE INVENTION

The present invention relates generally to hand tools and more particularly to an improved wrench of the type, generally referred to as a ratchet wrench, or simply as a "ratchet".

It will be appreciated by those skilled in the art that ratchet wrenches, or ratchets as they are commonly referred to by mechanics, have been available for many years as a convenient hand tool. A multitude of improvements to the basic ratchet wrench have been developed, including reversing mechanisms which will allow the ratchet to tighten in one direction and free ride in the other or free ride in the one and tighten in the other, spinners to advance the ratchet mechanism until it is finger tight about the work piece, remote reversal mechanisms and the like. These advancements in the art have been well received and generally commercially successful.

One of the problems experienced by mechanics and others using ratchet wrenches is the ability to manipulate the hand tool when operating in a confined area. Often times the ratchet wrench is being used in a restricted area with limited movement available to the wrench. In fact, these applications are generally where ratchet wrenches can be most effective. For example, if a wrench can only be turned through an arc of 10°, it would be extremely difficult to remove a wrench from a nut after it had moved 10°, replace it on the nut and tighten the nut another 10°, continue the process until the nut is fully tightened. Ratchet wrenches, on the other hand, allow this operation to occur by simply placing the socket of the wrench over the head of the nut, rotating the wrench to tighten the nut through the allowed arc, reversing the rotation of the arc and letting the ratchet free ride and continue the process until the nut is tightened.

It has long been recognized that in the applications of the type just described, the nut to be tightened may have to turn on several threads to tighten and can, in certain circumstances, be so loose that it will not hold the socket in place when the handle of the ratchet wrench is reversed after the handle has been passed through the small arc to tighten the nut. In these circumstances, it is necessary to tighten the nut finger tight before using the wrench, but reaching the nut can be restricted.

There have been several efforts at developing a method of finger tightening the nut in the circumstances just described by using the wrench. A so-called "spinner" mechanism has been developed as a modification to a standard ratchet wrench which allows the carrier for the socket to be spun to tighten the nut to a finger tight condition so that the ratchet wrench can operate effectively. However, in this circumstance, it is, once again, necessary for the mechanic to be able to get his fingers onto the spinner in order to effectively spin the socket carrier to the point where the nut is adequately finger tight.

At least one inventor has recognized the problem associated with confined working quarters and loose nuts being tightened by a ratchet wrench. Specifically, Faso was issued a patent in 1966, U.S. Pat. No. 3,283,621, which had a ratchet wrench with a mechanism remote from the head of the ratchet to tighten the socket to make the nut finger tight or to loosen the nut completely from a bolt when the process is being reversed. Unfortunately, there are shortcomings with the Faso device. Specifically, to turn the knob or finger piece of the Faso wrench in order to rotate the socket, the user must be able to hold the handle of the wrench in one hand and get a second hand into confined quarters to reach the knob and turn it. Many applications make this procedure impractical if not impossible.

What is needed, then, is a ratchet wrench with a mechanism for turning the socket holder of the wrench, which mechanism can be operated by the fingers of the hand holding the handle of the wrench without having to reach the head of the wrench where the socket holder is located. This heretofore unsatisfied need is met by the invention of the present application.

SUMMARY OF THE INVENTION

Applicant's invention is a ratchet wrench having a handle and a head of know configuration with the head including a raceway in which is mounted a spur gear. The spur gear has a shaft passing through it which cooperates with the head of the wrench to hold the gear in place with one end of the shaft including a post for attachment of a socket. Within the head of the wrench is a pawl mechanism for engaging the teeth of the spur gear so that when the handle is rotated in one direction, the pawl mechanism will engage the spur gear and turn the spur gear, its shaft and the post to which a socket is attached. When the handle is rotated in the opposite direction, the pawl mechanism will ride over the spur gear so that the spur gear will remain stationary. The improvement of applicant's invention is an advancing lever built into the handle of the wrench. The advancing lever includes an advancing rod with camming teeth on the free end of the advancing rod and pivotally connected to a link rod at the opposite end. The advancing rod can be shifted from one side or the other of the head so as to engage one side or the other of the spur gear and thereby advance the spur gear in one direction or the other depending upon the side on which the advancing rod is placed. The advancing rod is activated by the link rod pushing toward the spur gear in response to force applied to the advancing lever on the handle of the wrench. The advancing lever is fitted within a slot in the handle and connects to the link rod so that the advancing lever can be pushed toward the head of the wrench to push the advancing rod forward. The advancing lever is then returned to its original position by the force of a coil spring wrapped about the link rod. Thus, the advancing lever can be pushed forward and then retracted by the force of the spring in a continuously repeated process until the advancing rod has rotated the spur gear sufficiently to tighten the nut so that the normal use of the ratchet wrench can begin.

DESCRIPTION OF THE PREFERRED EMBODIMENT

The present invention will be best understood upon a review of the following description of the preferred embodiment, taken in conjunction with the drawings appended hereto which illustrate the preferred embodiment and wherein like numerals refer to like parts.

Figure 1:
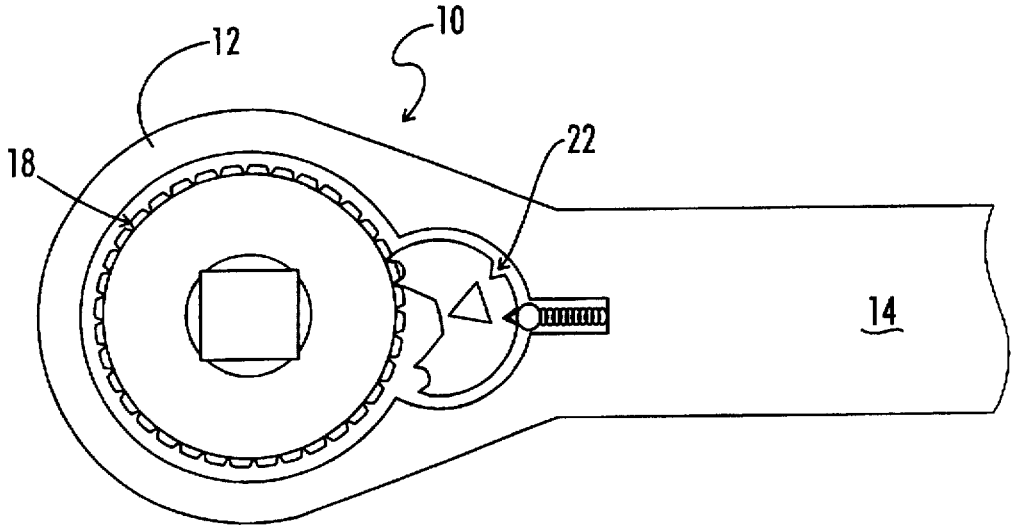
FIG. 1 (PRIOR ART)
FIG. 1 shows a top view and cut away of a typical prior art ratchet wrench.
Figure 2:
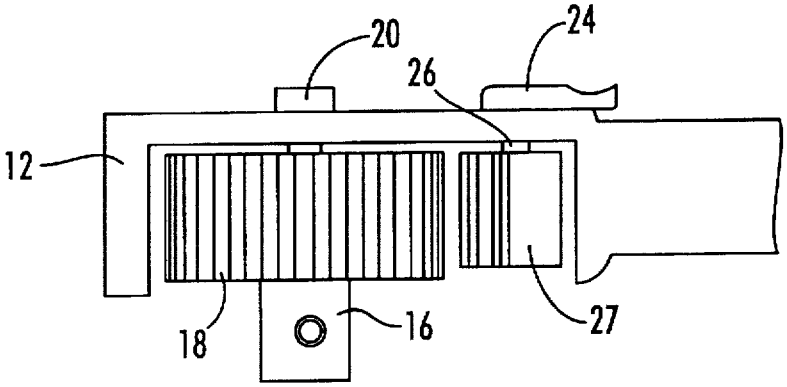
FIG. 2 (PRIOR ART)
FIG. 2 shows a side view partially cut away of the typical prior art ratchet wrench of FIG. 1.

A typical ratchet wrench is illustrated in U.S. Pat. No. 4,699,028 issued to Bosque on Oct. 13, 1987. Reference may be had to the Bosque patent for the general configuration of a ratchet wrench. Bosque also illustrates a spinner mechanism, remotely operated to rotate with the socket shank 16*k*. Applicant's prior art illustrations in FIGS. 1 and 2 show a ratchet wrench 10 having a front housing 12, a handle 14 and a gear assembly 16. The prior art device as is illustrated in FIGS. 1 and 2 includes a two position pawl assembly 22 designed to engage the spur gear for rotation of the socket shank 16 in either a clockwise or a counter-clockwise direction. The pawl assembly includes a pawl lever 24 connected via a pawl carrier or shaft 26 to the pawl 27 that dictates the direction of turn of the socket in response to movement of the handle 14.

Considering now FIGS. 3–6, therein is illustrated in detail the preferred embodiment of Applicant's improved ratchet wrench. Applicant's wrench 10 includes a head 12 and a handle 14 with a socket shank 16 of standard construction projecting from the bottom of the head of the wrench. The socket 16 is an extension of the gear shaft 20 which carries the spur gear 18 (see FIG. 5). The spur gear 18 fits within a raceway in the head 12 similar to the raceway illustrated in FIGS. 1 and 2. Applicant's improved ratchet wrench also includes a pawl lever 24 as is generally provided in the prior art devices for switching the pawl between engagement for clockwise rotation or counter-clockwise rotation of the wrench as is desired depending upon the application. The pawl lever 24 is connected to a pawl carrier or shaft 26 which follows the movement of the pawl lever 24 and the pawl 27 is held in place by a detent ball and spring mechanism as is illustrated in FIG. 1. In Applicant's invention, the pawl mechanism (see FIG. 2*a*) will be of slightly lesser thickness than the pawl shown in FIGS. 1 and 2 of prior art devices and of a sufficiently reduced thickness so that a portion of the spur gear depends below the pawl. The greater thickness of the spur gear allows the advancing rod of Applicant's invention to extend below the pawl 27 and co-act with the spur gear 18 in the manner described hereinafter.

Provided on the handle 14 of Applicant's improved ratchet wrench is advancing lever 30 extending from the slot 32 in the sides of the handle 14. The advancing lever 30 includes a slide bar 34 which extends across the width of the handle 14 and protrudes out of the handle 14 through the slots 32, terminating at its end with finger pads 36. Thus, the advancing lever can be moved forwardly and backwardly within the slot 32 by finger or thumb pressure using the digits of the hand of the mechanic holding the handle 14.

Internally mounted within the handle 14 is a link rod 38 having opposing ends with its proximal end connected to the slide 34 and its distal end extending into the head 12 of the wrench. The distal end extends through an opening (not shown) in the retaining bar 42. The retaining bar 42 is an element provided to hold the spring 40 in place about the link rod 38. Thus, as the advancing lever 30 is pushed toward the distal end (or the head) of the wrench, the spring 40 will be compressed and the release of pressure from the advancing lever will result in the spring 40 pushing the advancing lever toward the proximal end (or handle) of the wrench.

Connected to the distal end of the link rod is an advancing rod 44 via a pivotal pin 45. The advancing rod 44 has a pawl 46 at its free end and is in proximate relationship to the spur gear 18. When the advancing rod is in the position shown in FIG. 5, activating the advancing lever 30 will cause the pawl 46 to engage the spur gear 18 and advance the gear in a clockwise direction. As the advancing lever is retracted, pawl 46 will ride over the teeth of the gear 18 with repeated movement of the advancing lever causing the ratchet to quickly tighten to a finger-tight position before the wrench itself is used to complete the process.

Figure 6:
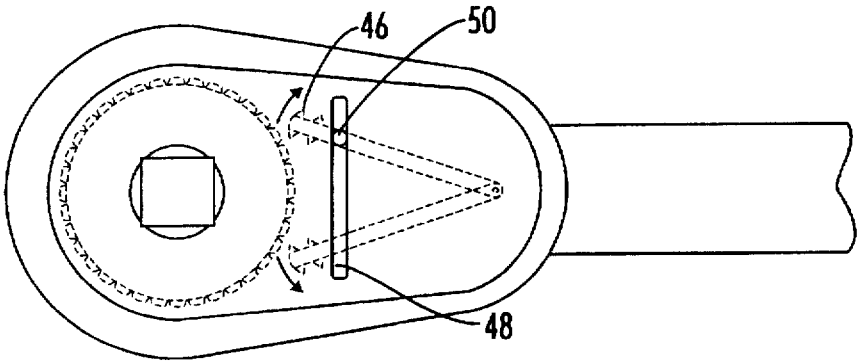
FIG. 6 is another top view of the ratchet wrench of the present invention.

If it is desired to turn the gear in a counter-clockwise position, the advancing rod 44 is shifted via the flipper pin 50 to the position shown in FIG. 6. The flipper pin 50 is attached to the bottom of the advancing rod 44 and extends through the slot 48 so that the advancing rod can be moved from side to the other of the gear 18. When the flipper pin 50 is moved to the position shown in FIG. 6, the advancing rod is on the upper side of the gear 18 and the teeth on the lower portion of the free end of the advancing rod 44 serve to ratchet the gear 18 in a counter-clockwise direction by movement of the advancing lever 50 toward the head 12. When the advancing lever retracts, the ramp of the teeth of the pawl 46 ride over the teeth of the gear 18 so that they will not move the gear 18 except when the advancing rod is advanced or pushed in the direction of the distal end of the wrench.

Figure 2A:
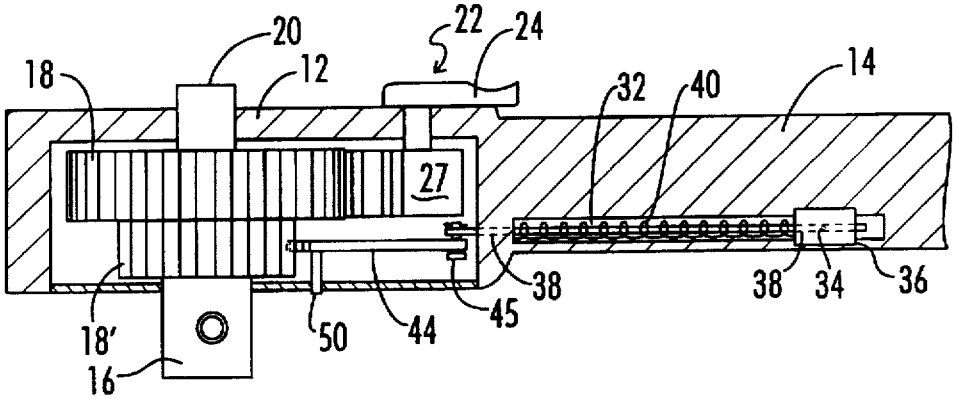
FIG. 2*a* shows a side view, in partial cross section, of one embodiment of the present invention.
Figure 3:
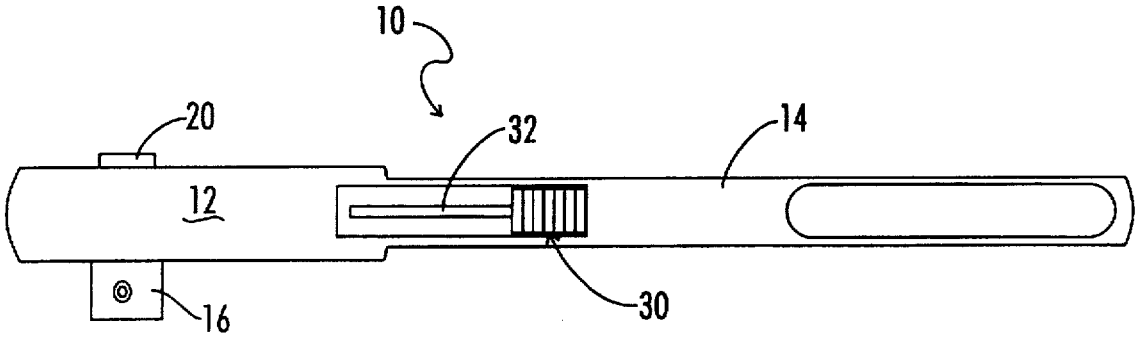
FIG. 3 shows a side view of the ratchet wrench of the present invention.
Figure 4:
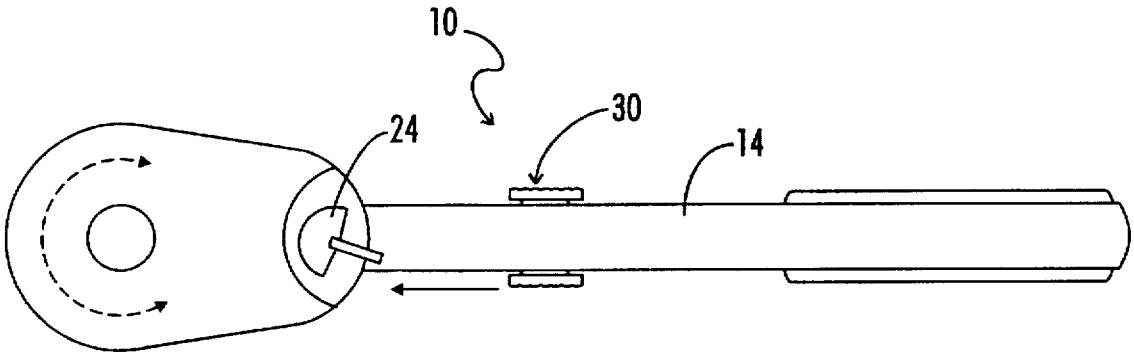
FIG. 4 shows a top view of the ratchet wrench of the present invention.
Figure 5:
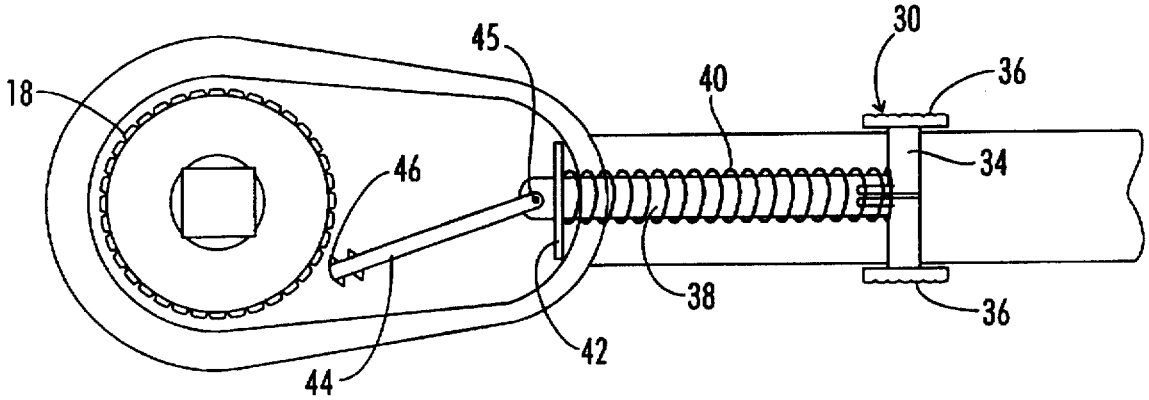
FIG. 5 shows a top view partially cut away of the ratchet wrench of the present invention.

FIG. 2*a* illustrates a stepped down gear 18 having a reduced diameter section 18'. The reduced diameter section can be the full diameter of the spur gear, but the illustration, for purposes of clarity, show the advancing section of the gear as being smaller. The significance of the section 18' is that the teeth on that section of the gear may need to be more triangular in profile, rather than a true spur gear profile in order for the teeth of the of the pawl 46 to properly engage the gear teeth considering the angle at which the meet.

Figure 7:
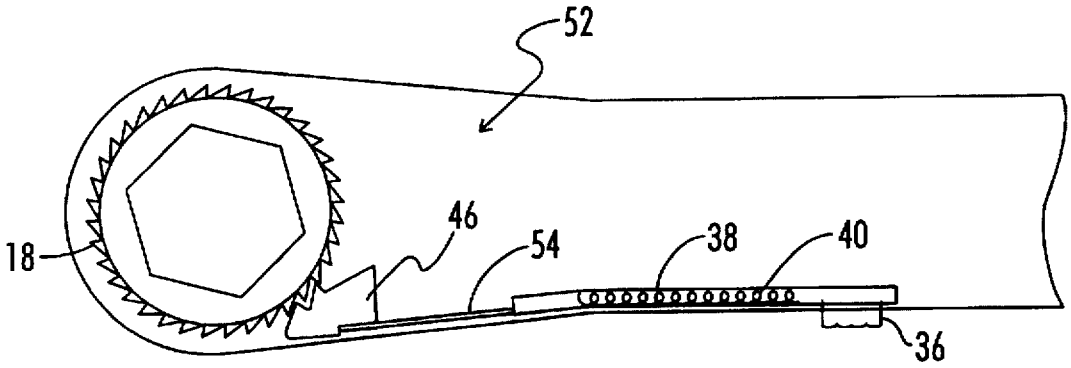
FIG. 7 is a top view of a standard ratcheting box wrench.
Figure 8:
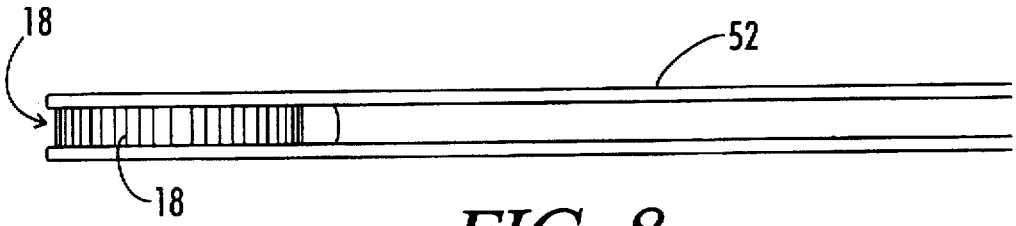
FIG. 8 is a side view of a standard ratcheting box wrench.
Figure 9:
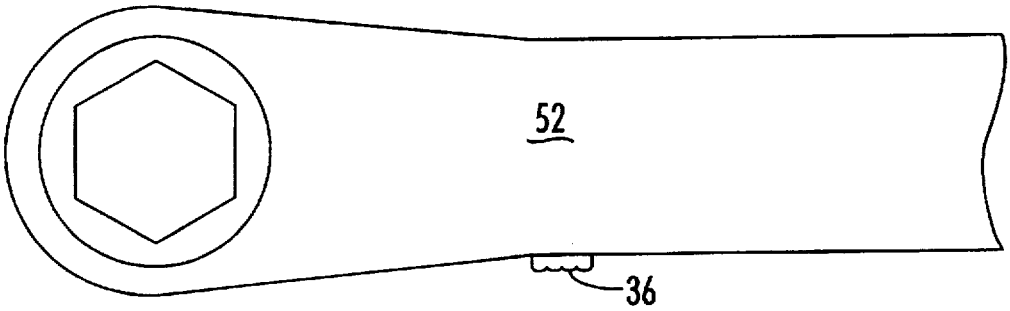
FIG. 9 shows a schematic top view of a ratcheting box wrench including an advancing lever of the type disclosed herein.

FIGS. 7, 8 and 9 illustrate in schematic form the application of the improved advancing lever mechanism of the present invention to a ratcheting box wrench. A ratcheting box wrench, as is well known in the art, works similar to a ratchet wrench, but they typically only work in one direction. The wrench is basically flat and is turned over to reverse the direction of forced turn versus free ride. In adapting the advancing lever of the present invention to a ratcheting box wrench, the advancing lever would only be required on one side and would not have to be reversible. As is illustrated in FIG. 7, the advancing lever would simply be constructed as a pawl 46 with a flat tensioning spring 54 connected to a link rod 38 which would be in turn connected to the advancing lever 30. The tension spring 54 would force the pawl 46 in engagement with the spur gear teeth 18 provided on the ratcheting box wrench. When the pawl is moved in the direction of the handle (away from the head at the end of the box wrench 52), the pawl teeth would pull the spur gear in a counter-clockwise direction as is shown in FIG. 7. The advancing lever is activated by the thumb and finger of the hand holding the handle of the wrench pressing against the finger pads 36 and pushing the link rod in the direction of the head of the wrench. The coil spring 40 will then return the advancing lever to its at rest position by expanding and forcing the mechanism to move from left to right as is illustrated in FIG. 7. Movement from left to right (as illustrated in FIG. 7) will cause the pawl 46 to pull against the teeth of the spur gear and rotate the spur gear in a counter-clockwise direction. When the advancing lever is pushed from right to left, the teeth ride over the spur gear teeth while the box wrench remains stationary.

Thus, although there have been described particular embodiments of the present invention of a new and useful ratchet wrench with remote advancing lever, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An improved ratchet wrench, said ratchet wrench including an elongated handle with opposing ends, including a free proximal end and a head on the distal end thereof, the head including a cavity, said cavity including a raceway to receive a gear and pawl assembly, and a gear and pawl assembly mounted within said cavity, means for switching said pawl assembly between two alternate positions, the first alternate position causing the pawl assembly to turn the gear in one direction while free riding in an opposite direction and a second alternate position causing the pawl assembly to force said gear to turn in the opposite direction while free riding in the one direction, the improvement including an advancing mechanism for rapidly and easily advancing said gear, said advancing mechanism including a slot in said handle running at least partially along the length of said handle between its opposing ends, a channel within the body of said handle, said channel communicating with the cavity in the head of the wrench, an advancing lever mounted within said channel and protruding from inside said handle through said slot, an advancing arm having opposing ends, said advancing arm connected at one end to said advancing lever and having a pawl on the opposite end, said pawl on said advancing arm positioned to engage said gear for rotating said gear when said advancing arm is moved in one direction and for free riding over said gear when said advancing arm is moved in an opposite direction, and a spring positioned within the said channel in said handle for counteracting pressure on said advancing lever to move said advancing lever along the length of said slot whereby said advancing lever can be moved in a reciprocal motion by a user of said wrench to advance said gear rapidly to place said wrench in an operable position.

2. The improved ratchet wrench of claim 1 wherein said advancing arm can be switched between two alternate positions, the first alternate position causing said gear to turn in one direction when the advancing lever is moved in a reciprocal motion along the length of the handle of the wrench and to cause said gear to move in an opposite direction when said advancing lever is in the second alternate position upon movement of said advancing lever in the reciprocal motion along the length of the handle of said ratchet wrench.

3. The improved ratchet wrench of claim 2 further including a positioning pin connected to said advancing arm, and protruding from said head, said positioning pin facilitating the movement of said advancing arm between said first alternate position and said second alternate position.

4. The improved ratchet wrench of claim 1 further including a linking rod between said advancing lever and said advancing arm.

5. The improved ratchet wrench of claim 4 wherein spring is a coil spring positioned to encircle said linking rod.

6. The improved ratchet wrench of claim 1 further including a second slot on said handle with said advancing lever protruding through said slots on opposing sides of said handle.

7. The improved ratchet wrench of claim 1 wherein said gear has a thickness and said pawl has a thickness with the thickness of said pawl being less than a thickness of said gear whereby said pawl mechanism can be mounted on said wrench between said gear and said advancing lever with clearance to allow said advancing arm to be moved between its two alternative positions without contacting said pawl mechanism.

* * * * *